US006311855B1

(12) United States Patent
Ali et al.

(10) Patent No.: US 6,311,855 B1
(45) **Date of Patent: *Nov. 6, 2001**

(54) DISPLAY RACK FOR SUPPORTING PACKAGES OF ABRASIVE SHEETS ON A DISPLAY STAND

(76) Inventors: Terry Ali; Christopher Ali; Phillip Glenn Ali, all of 611 Yellow Springs-FairField Rd., Fairborn, OH (US) 45324

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/383,156

(22) Filed: Aug. 25, 1999

(51) Int. Cl.[7] ..... A47F 5/10

(52) U.S. Cl. ..... 211/184; 211/133.6; 211/51

(58) Field of Search ..... 211/184, 43, 40, 211/41.12, 133.6, 10, 11, 46, 51; 206/561, 557; 108/60, 61

(56) References Cited

U.S. PATENT DOCUMENTS

| | | | | |
|---|---|---|---|---|
| D. 431,744 | | 10/2000 | Ali et al. | D6/567 |
| 1,157,045 | * | 10/1915 | Risher | 220/531 |
| 1,473,064 | * | 11/1923 | Vance | 108/61 |
| 1,691,743 | * | 11/1928 | Ulrich | 211/51 |
| 1,739,545 | * | 12/1929 | Cubberley | 220/549 |
| 3,417,875 | * | 12/1968 | Barker | 211/136.6 X |
| 4,209,093 | * | 6/1980 | Soderland | 206/425 |
| 4,327,835 | * | 5/1982 | Leger | 211/41.17 |
| 4,364,475 | * | 12/1982 | D'Elia | 206/425 |

FOREIGN PATENT DOCUMENTS

| | | | | |
|---|---|---|---|---|
| 1362684 | * | 4/1964 | (FR) | 211/184 |

* cited by examiner

*Primary Examiner*—Gregory J. Strimbu
(74) *Attorney, Agent, or Firm*—R. William Graham

(57) ABSTRACT

A display rack for supporting and displaying packages of abrasive sheets including a movable divider and an open housing having a bottom, a front end wall, a back end wall, and a pair of side walls. The bottom includes a plurality of openings spaced apart along the bottom. The divider includes a pair of L-shaped tabs which engage a first pair of the openings and includes a pair of angular-shaped tabs which engage a second pair of the openings to secure the divider in the open housing. The display rack can be attached to a display stand with screws, bolts or rivets.

9 Claims, 3 Drawing Sheets

Fig.1b
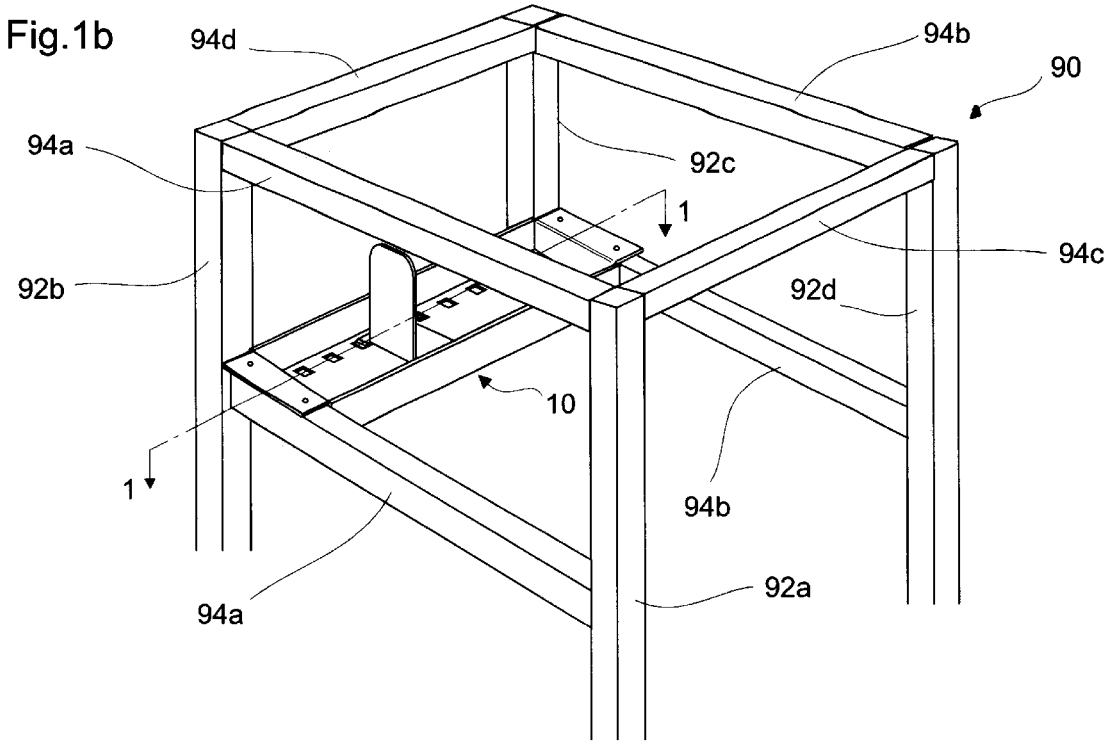
Fig. 1c
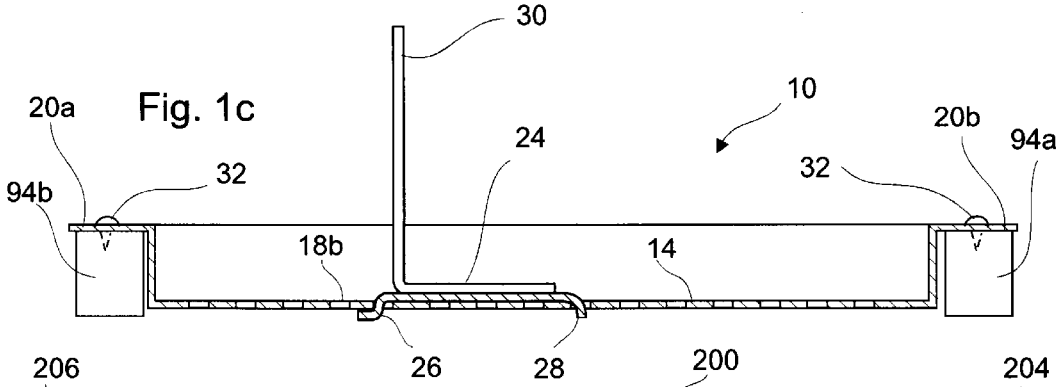
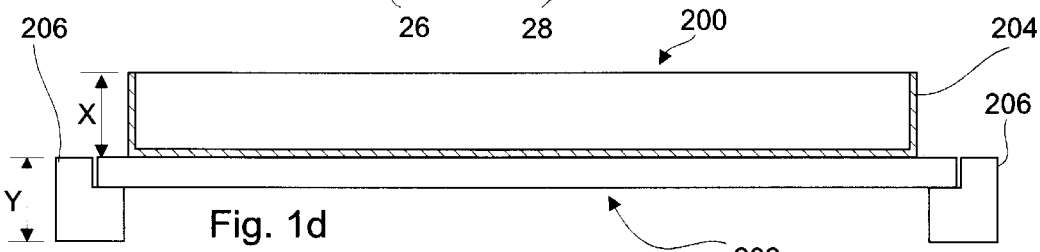
Fig. 1d
Prior Art

DISPLAY RACK FOR SUPPORTING PACKAGES OF ABRASIVE SHEETS ON A DISPLAY STAND

BACKGROUND OF THE INVENTION

1. Field of the Invention

The present invention relates generally to the field of display racks. More particularly, but not by way of limitation, the invention relates to a display rack for supporting packaged abrasive sheets or the like on a conventional display stand.

2. Related Art

There exist a number display stands for displaying abrasive sheets, discs, wheels, and the like. Most commonly, these goods are placed flat on a shelf in a stacked manner and slidably removed from the shelf. Another common method of displaying such goods is to dispose the goods within a packing material having a paper tab portion with an eyelet therein such that the goods hang on a peg board type stand.

Some of these goods, e.g., abrasive discs, are heavy and are relatively limited in number of units which can be horizontally displayed on a peg board type stand. Such goods can be stacked in large numbers on a shelf in a flat manner. This is not as preferred since the goods are not as easily viewed by the customer. Additionally, peg board type displays typically use a packaging to hold the goods, which adds further cost to product.

Retail stores are extremely concerned about the methods of displaying goods in an efficient manner which is easily utilized by the consumer. Consequently, retail stores are continuously searching for better ways to display goods.

Traditionally, retail hardware and do-it-yourself stores throughout the country use stock display shelving as seen in FIG. 1*d* which has a rectangular metal 3" framework having sides and shelves which removably interlock. Horizontal support members of the framework are configured with an L-shaped ¾" recess which extends longitudinally along the inside of the horizontal support members. ¾" thick boards are cut to fit between the horizontal support members such that the ends of the boards rest in the L-shaped recess. The goods are then slid directly on shelves or are placed in containers which are then shelved. Conventionally, the distance between the horizontal support members has to accommodate the size of the container or goods being shelved in such slidable manner. While this has provided a relatively stable shelf, it fails to maximize the usable space within the display area.

Accordingly, there remains a need to provide a more efficient display rack which is also user friendly. The present invention is intended to solve the above problems.

BRIEF SUMMARY OF THE INVENTION

It is an object to improve display racks.

It is another object to improve racks which display abrasives.

It is yet another object to provide a rack with improved functional and aesthetic characteristics.

It is still another object to provide a display rack with improved space saving design while maintaining user friendly aspects.

Accordingly, the present invention is directed to a display rack for supporting packages of abrasive sheets on a conventional display stand. The display stand is of the type having at least four vertical supports which are interconnected by a plurality of horizontal supports in a manner such that the vertical supports and horizontal supports are fixed in a generally rectangular configuration. A first horizontal support is disposed on one pair of the vertical supports and a second support is disposed on another pair of the vertical supports in a generally parallel and opposing manner. The horizontal supports having a like predetermined thickness.

The display rack includes an open housing having a bottom of a length substantially equal to a distance between the first and the second horizontal support and side walls extending generally normal to the bottom to form a container and having a wall size substantially equal to the thickness of the horizontal supports. The bottom includes a plurality of open surfaces longitudinally spaced along the bottom. Also, a front flange portion extends from a front side wall portion and a back flange portion extends from a back wall portion wherein the flange portions sit on opposing horizontal supports. A movable divider is provided having a base which is configured with at least one positioning tab to removably dispose in at least one the open surfaces to secure the divider in place.

Other objects and advantages will be readily apparent to those skilled in the art upon viewing the drawings and reading the detailed description hereafter.

BRIEF DESCRIPTION OF THE DRAWINGS

FIG. 1*b* is a perspective view of the display rack of the present invention shown in use with part of conventional frame structure.

FIG. 1*c* is a cross-sectional side view of FIG. 1*b* taken through line 1—1.

FIG. 1*d* is a cross-sectional view of a Prior Art display rack.

DETAILED DESCRIPTION OF THE INVENTION

Figure 1A:
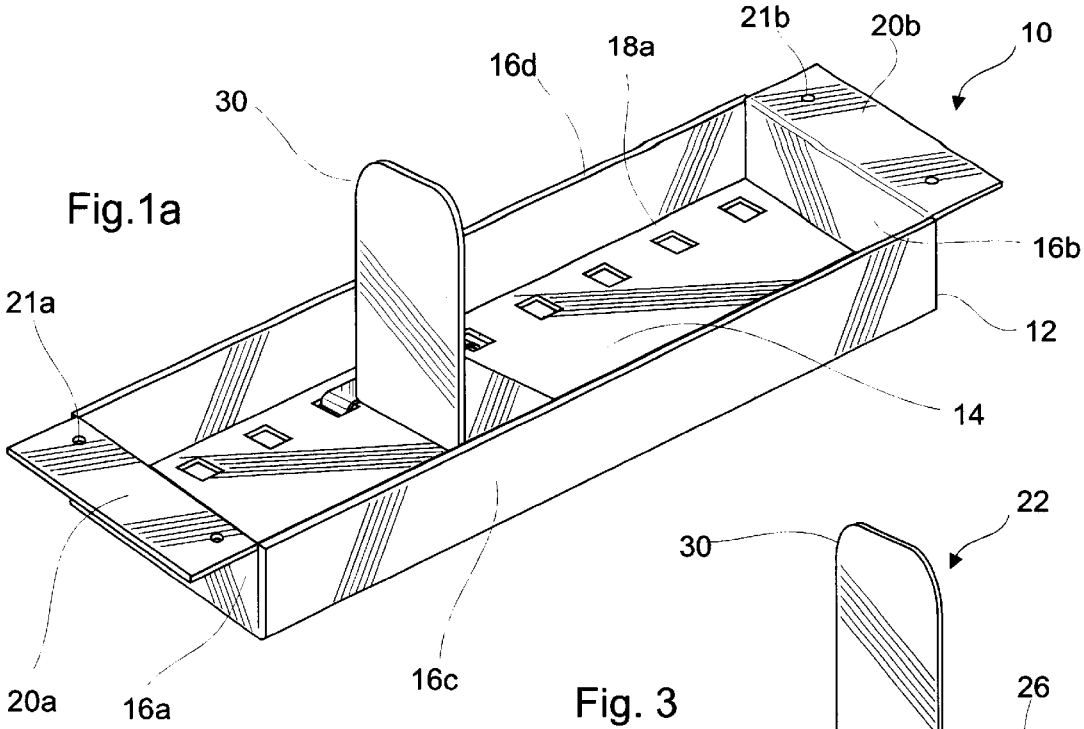
FIG. 1*a* is a perspective view of a display rack of the present invention.
Figure 3:
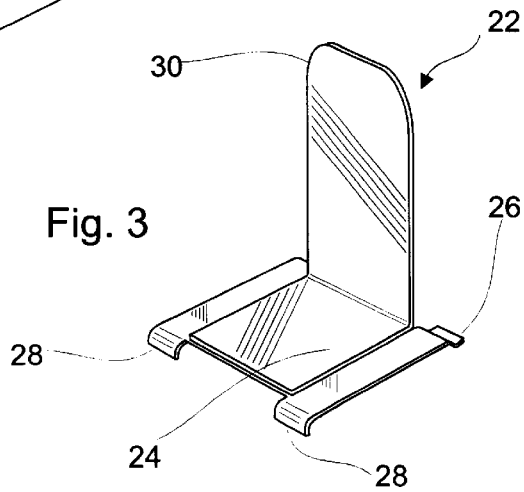
FIG. 3 is a perspective view of a divider of the present invention.
Figure 2:
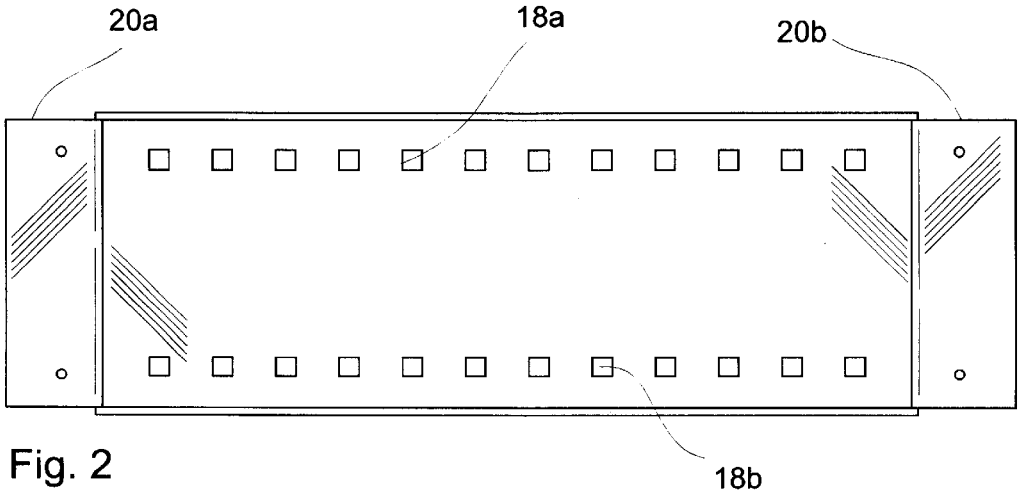
FIG. 2 is a top view of the display rack of the present invention.
Figure 4:
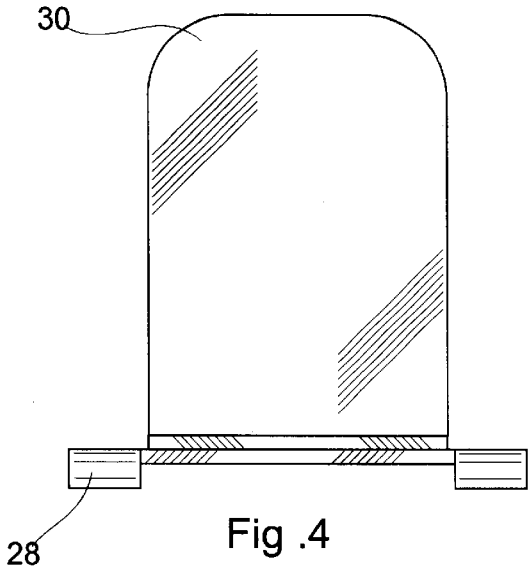
FIG. 4 is an end view of the divider of FIG. 3.
Figure 6:
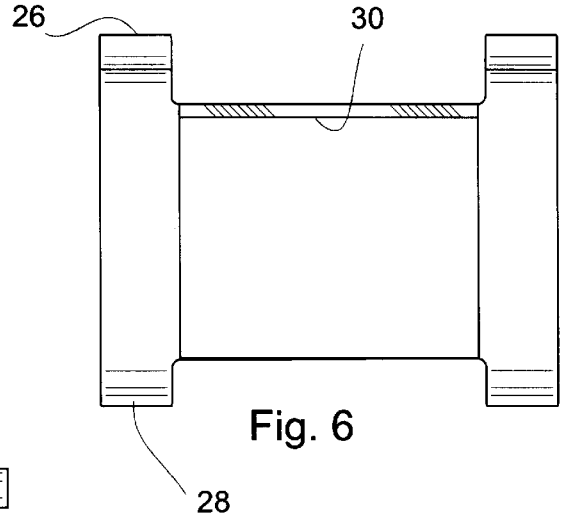
FIG. 6 is a bottom view of the divider of FIG. 3.
Figure 5:
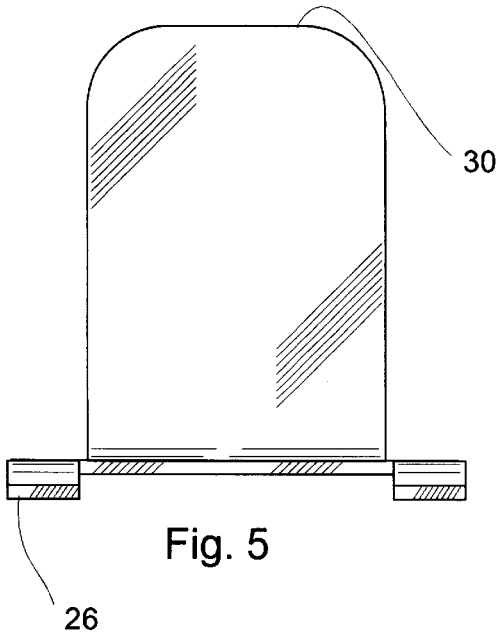
FIG. 5 is another end view of the divider of FIG. 3.
Figure 7:
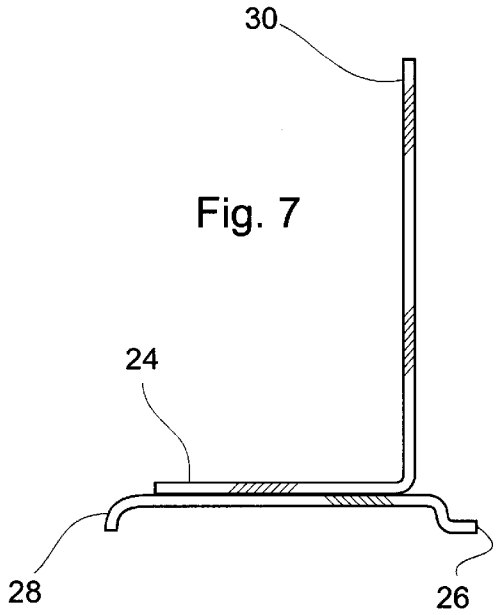
FIG. 7 is a side view of the divider of FIG. 3.

Referring now to the drawings, a display rack 10 is provided for supporting packages of abrasive sheets (not shown) on a conventional display stand 90. The display stand 90 is of the type having at least four vertical supports 92*a*, 92*b*, 92*c* and 92*d* which are interconnected by a plurality of horizontal supports 94*a*, 94*b*, 94*c* and 94*d* in a manner such that the vertical supports 92*a*, 92*b*, 92*c* and 92*d* and horizontal supports 94*a*, 94*b*, 94*c* and 94*d* are fixed in a generally rectangular configuration. The display stand 90 is further characterized such that the horizontal supports 94*a*, and 94*b* are disposed in a generally parallel and opposing manner and generally in a horizontal relationship, and similarly so are horizontal supports 94*c* and 94*d*. The horizontal supports 94*a*, 94*b*, 94*c* and 94*d* commonly have a like predetermined thickness and are adjustably connectable to the vertical supports 92*a*, 92*b*, 92*c* and 92*d* to a selectable height.

As seen in FIG. 1*d*, a prior art display rack 200 is depicted. Here, the deficiency in functionality of the prior design and waste of space is seen. Space is lost in the region 202. This is due the fact that when packages of abrasive sheets for example, are shelved in a container 204, for example, the horizontal supports 206 (having a thickness Y) must be further spaced from one another a distance substantially equal to X+Y+ thickness of goods (not shown) to permit easy access and clearance past the bottom portion of an above located horizontal support (not shown). This is not so with the present invention, wherein the spacing between the horizontal supports 94*a,* and 94*a* need be only slightly more than X+ the thickness of goods (not shown) which is substantially less than the prior art design. This is accomplished using the following.

The display rack 10 includes a housing 12 having a bottom 14 of a length slightly less than a distance between the horizontal supports 94*a,* and 94*b* and four generally rectangular side walls 16*a,* 16*b,* 16*c* and 16*d,* wherein side walls 16*a* and 16*b* oppose one another and side walls 16*c* and 16*d* oppose one another. The side walls 16*a,* 16*b,* 16*c* and 16*d* are interconnected to one another and extend generally perpendicular to the bottom 14. The side walls 16*a–d* are of a height approximately equal to the thickness (X) of horizontal support members 94*a,* and 94*b*.

There are a plurality of openings surfaces 18*a* and 18*b* which are formed in the bottom 14. The openings 18*a* 18*a* and 18*b* are generally equidistantly spaced from another and extend longitudinally in one or more rows from side wall 16*a* to side wall 16*b*. Typically, the openings 18*a* and 18*b* are equidistantly spaced in two rows.

Connected to upper edges of the side walls 16*a* and 16*b* are laterally extending flange portions 20*a* and 20*b*. The flange portions 20*a* and 20*b* are designed to rest on horizontal support members 94*a* and 94*b,* respectively, of rectangular shaped display shelf 90. The flange portions 20*a* and 20*b* have openings 21*a* and 21*b*. The flange portions 20*a* and 20*b* need be of sufficient length and strength to support the display rack 10 with goods therein. In this regard, the display rack 10 is preferably integrally formed of a rigid material, such as steel. The display rack 10 can be secured to the horizontal support members 94*a,* and 94*b* by employing a mechanical fastener 32, such as screws, bolts, rivets or the like through openings 21*a* and 21*b*.

Also, provided is a divider 22. The divider 22 has a horizontal base 24, L-shaped tabs 26 which extend from one side of the base 24 and angular tabs 28 which extend from another side of the base 24. The tabs 26 and 28 are spaced from one another in a manner to be readily removably disposed into the openings 18*a* and 18*b* as shown in FIG. 1*a,* 1*b* and 1*c*. The base 24 has a vertical package support member 30 extending vertically from one end of the base 24. The tabs 26 are inserted first into the open surfaces 18*a* and 18*b* and then the tabs 28 are inserted into the open surfaces 18*a* and 18*b* to lock the divider 22 in a longitudinal position.

By so providing, the display rack 10 of the present invention does away with the need for horizontal boards which conventionally extend from a top edge of one horizontal support to a top edge of another horizontal support member and leave wasted space beneath the horizontal supports. Instead, the present invention drops the bottom 14 of the display rack 10 down to the bottom of the horizontal supports with 94*a* and 94*b* so that there is no wasted space beneath the horizontal supports 94*a* and 94*b*.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be read in their full scope including any such modifications, derivations and variations.

What is claimed is:

1. A display rack for supporting and displaying packages of abrasive sheets comprising;

an open housing having a bottom, a front end wall, a back end wall, and a pair of side walls, said front end wall, said back end wall, and said pair of side walls extending generally vertically upward from said bottom to form a container portion, said front end wall including a front flange portion extending horizontally outward from an upper end of said front end wall, and said back end wall including a back flange portion extending horizontally outward from an upper end of said back end wall, and said bottom including a plurality of openings longitudinally spaced apart along said bottom; and a movable divider disposed in said open housing, said movable divider having a horizontal base and a package-retaining member extending vertically upward from said horizontal base, said horizontal base including support members extending from said horizontal base wherein said support members comprise a first pair of L-shaped tabs extending from a front end of said horizontal base and a second pair of angular-shaped tabs extending from a back end of said horizontal base such that said first pair of L-shaped tabs engage a first pair of corresponding openings of said plurality of openings spaced apart along said bottom and said second pair of angular-shaped tabs engage a second pair of corresponding openings of said plurality of openings spaced apart along said bottom to positionally and pivotally secure said divider in said open housing.

2. The display rack of claim 1 wherein said L-shaped tabs are pivotally engaged in said first pair of corresponding openings in said bottom of said open housing such that said package-retaining member tilts forward upon exertion of forward pressure thereto.

3. The display rack of claim 1 wherein said front flange portion and said back flange portion include openings through which mechanical fasteners may be used to secure said front flange portion and said back flange portion to a display stand.

4. The display rack of claim 3 wherein said mechanical fasteners are selected from the group consisting of screws, bolts and rivets.

5. The display rack of claim 1 wherein said display rack is formed of a rigid material.

6. The display rack of claim 5 wherein said rigid material is used.

7. A display rack for supporting and displaying packages of abrasive sheets in combination with a display stand, wherein said display rack comprises: an open housing having a bottom, a front end wall, a back end wall, and a pair of side walls, said front end wall, said back end wall and said side walls extending generally vertically upward from said bottom to form a container portion, said front end wall including a front flange portion extending horizontally outward from an upper end of said front end wall, and said back end wall including a back flange portion extending horizontally outward from said back end wall, and said bottom including a plurality of openings longitudinally spaced apart along said bottom; and a movable divider disposed in said open housing, said movable divider having a horizontal base including support members extending from said horizontal base wherein said support members comprise a pair of L-shaped tabs extending from a front end of said horizontal base and a pair of angular-shaped tabs extending from a back end of said horizontal base such that said pair of L-shaped tabs engage a first pair of corresponding openings of said plurality of openings spaced apart along said bottom, and said pair of angular-shaped tabs engage a second pair of corresponding openings of said plurality of openings spaced apart along said bottom to positionally and pivotally secure said divider in said open housing; and said display stand comprises at least four vertical support members which are interconnected by a plurality of horizontal support members such that a pair of said horizontal support members are in a generally parallel relationship, and said front flange portion of said display rack and said back flange portion of said display rack are secured to said display stand by mechanical fasteners selected from the group consisting of screws, bolts and rivets such that said flange portions rest on said pair of said horizontal support members of said stand and said container portion is disposed in a horizontal plane between said pair of said horizontal support members.

8. The combination of claim 7 wherein said display rack is formed of a rigid material.

9. The combination of claim 8 wherein said rigid material is steel.

* * * * *